US011679904B2

(12) United States Patent
Spoetta

(10) Patent No.: US 11,679,904 B2
(45) Date of Patent: Jun. 20, 2023

(54) METHOD FOR THE AUTOMATIC PACKAGING OF AT LEAST TWO PARTS

(71) Applicant: R. Weiss Verpackungstechnik GmbH & Co. KG, Crailsheim (DE)

(72) Inventor: Georg Spoetta, Frankenhardt-Honhardt (DE)

(73) Assignee: R. Weiss Verpackungstechnik GmbH & Co. KG, Crailsheim (DE)

( * ) Notice: Subject to any disclaimer, the term of this patent is extended or adjusted under 35 U.S.C. 154(b) by 199 days.

(21) Appl. No.: 17/054,817

(22) PCT Filed: May 15, 2019

(86) PCT No.: PCT/EP2019/062470
§ 371 (c)(1),
(2) Date: May 27, 2021

(87) PCT Pub. No.: WO2019/219742
PCT Pub. Date: Nov. 21, 2019

(65) Prior Publication Data

US 2021/0284371 A1 Sep. 16, 2021

(30) Foreign Application Priority Data

May 15, 2018 (DE) ..... 10 2018 111 666.7

(51) Int. Cl.
*B65B 35/40* (2006.01)
*B65B 5/06* (2006.01)
*B65B 17/02* (2006.01)

(52) U.S. Cl.
CPC ..... *B65B 35/405* (2013.01); *B65B 5/067* (2013.01); *B65B 17/02* (2013.01); *B65B 2220/14* (2013.01)

(58) Field of Classification Search
CPC ..... B65B 5/12; B65B 5/067; B65B 17/00; B65B 17/02; B65B 35/205; B65B 35/405; B65B 2220/14
(Continued)

(56) References Cited

U.S. PATENT DOCUMENTS 2,104,095 A * 1/1938 Papendick ..... B65B 25/18 53/445
2,630,951 A 3/1953 Slightam
(Continued)

FOREIGN PATENT DOCUMENTS

DE 199 18 527 A1 10/2000
DE 695 19 147 T2 5/2001
(Continued)

OTHER PUBLICATIONS

PCT Search Report, dated Jul. 16, 2019.
German Patent Office Search Report, dated Feb. 20, 2019.

*Primary Examiner* — Stephen F. Gerrity
(74) *Attorney, Agent, or Firm* — Dority & Manning, P.A.

(57) ABSTRACT

A method for automatic joint packaging of at least a first part and a second part, the first part and the second part having different geometries, is provided. The method includes automatically placing a first part on a transport surface with a front side facing in a transport direction and automatically placing a second part on the transport surface with the second part in front of the first part relative to the transport direction. The method further includes automatically transporting the first part and the second part along the transport surface to a packaging device by moving a pushing device into engagement with a rear side of the first part and pushing the first part in the transport direction, wherein the second part is taken along by the front side of the first part pushed by the pushing device.

11 Claims, 2 Drawing Sheets

Figure 1:
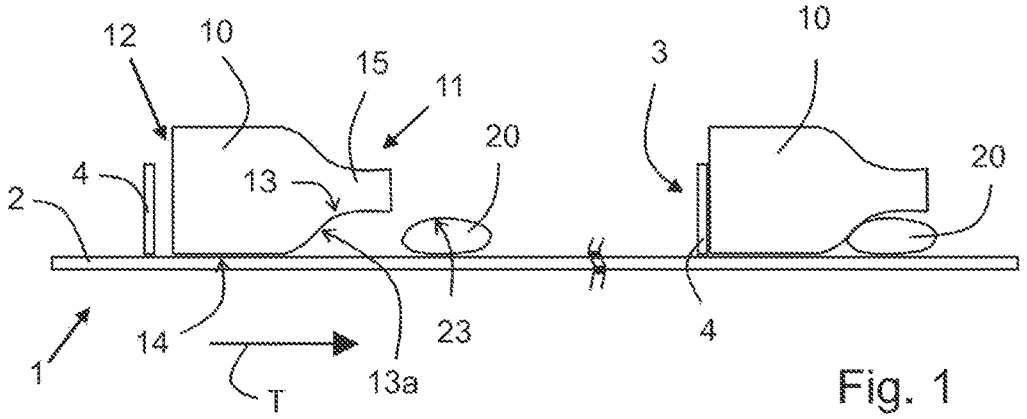

(58) Field of Classification Search
USPC ..... 53/154, 155, 237, 238, 445, 474
See application file for complete search history.

(56) References Cited

U.S. PATENT DOCUMENTS

| | | | | | |
|---|---|---|---|---|---|
| 2,968,898 | A * | 1/1961 | Hickin | B65B 21/06 | 53/157 |
| 3,076,298 | A * | 2/1963 | Tundermann | C11D 17/049 | 53/445 |
| 3,982,382 | A * | 9/1976 | Vogel | B65B 61/20 | 269/238 |
| 4,458,468 | A * | 7/1984 | Sivilich | B65B 5/06 | 53/445 |
| 5,146,729 | A * | 9/1992 | Sato | G11B 23/0233 | 53/445 |
| 6,470,653 | B1 * | 10/2002 | Lutz et al. | B65B 61/202 | 53/238 |
| 7,845,145 | B2 * | 12/2010 | Schroeder | B65B 61/202 | 53/445 |
| 2013/0334008 | A1 | 12/2013 | Overley et al. | | |

FOREIGN PATENT DOCUMENTS

| | | | | |
|---|---|---|---|---|
| DE | 10 2004 050197 | A1 | | 4/2006 |
| DE | 10 2005 017961 | A1 | | 10/2006 |
| DE | 10 2006 049801 | A1 | | 4/2008 |
| DE | 10 2011 119968 | A1 | | 6/2013 |
| EP | 1 801 016 | A1 | | 6/2007 |
| GB | 944 324 | A | | 12/1963 |
| JP | 06171606 | A | * | 6/1994 |

* cited by examiner

METHOD FOR THE AUTOMATIC PACKAGING OF AT LEAST TWO PARTS

The invention relates to a method for the automatic joint packaging of at least a first and a second part in a packaging, whereby the two parts have different sizes and geometries.

In a known method of this kind, a first part and a second part are placed in pairs side by side on a transport device designed as a conveyor belt and transported to a tubular bag packaging machine. The first part is, for example, a plastic bottle, for example a medical infusion bottle, and the second part is an adapter welded in a blister for later attaching or screwing onto the bottle. The disadvantage here is that the bottle and the blister can easily slip inside the tubular bag and therefore the automatic handling of the individual tubular bags including their contents by means of a robot during the subsequent collective packaging of the tubular bags into cartons or similar is difficult.

It is the task of the present invention to optimize the packaging of at least a first and a second part in a common packaging.

This task is solved by a method of the type mentioned above by the features of claim 1. Both the first and the second parts are automatically fed to the transport device by a first or second feeding device, respectively. The first parts are automatically placed on the transport surface in such a way that they are aligned in a defined manner in the transport direction, with a front side of the first parts facing in the transport direction and a rear side facing against the transport direction. Furthermore, the second parts are automatically placed on the transport surface, each in front of a first part, seen in the transport direction. The first and second parts are then conveyed together in pairs on the transport device to a packaging device. The pushing device, which is part of the transport device, grips the rear side of the respective first part and pushes it in the transport direction. The first part, on the other hand, takes a second part at its front side.

The advantages of the invention lie in particular in the fact that only the first part is pushed directly by a pushing device, taking the second part with it on its front side. "Front side" means the front area of the first part (not only its front face). The two parts to be packed together are therefore not next to each other on the transport device, but essentially in one line, preferably behind and/or above each other. During this transport, the respective geometries of the first and the second part are especially preferable taken into account, or even matched to each other, so that the two parts have an essentially defined position during transport. In this relative position to each other, the two parts are then packed together, whereby this relative position can be maintained if the packaging is tight-fitting. In this way, slippage of the second part relative to the first part in the packaging can be prevented.

Lateral guides along the transport surface can also be provided as an option in order to prevent second parts from slipping past the respective first parts in case of an imprecise relative position assignment between first and second part.

It is particularly preferred that each first part has a driver area in the area of its front side, which is preferably curved. This driver area is aligned in the direction of transport and takes the second parts with it. It is preferred if the driver area at least partially covers the second part in top view of the transport device. In other words, the second part is taken along by the first part on a lower side of the first part. This effectively prevents the second part from slipping sideways during pushing transport by the first part.

Every second part preferably has an entrainment area that is placed on the transport device in front of the driver area of the first part. When transporting together, the entrainment area of the second part is located at the driver area of the first part, preferably partly covered by the first part in top view, so that the first part can push the second part in front of it in a defined position with its driver area.

In this respect, it is advantageous if the driver area of the first part is an inward or outward projection and the entrainment area of the second part is an outward or inward projection. In this case, the outward or inward projection of the second part can be located at the inward or outward projection of the first part. In this case no exact form fit between the first and the second part is necessary. Preferably, it is sufficient if the second part cannot slip past the first part against the transport direction.

According to a particularly preferred design, the first part is a bottle whose driver area is the bottle neck. This bottle neck is aligned especially preferable on the transport surface in transport direction. The second part, according to this particularly preferred design, is a blister that is placed on the transport surface and, at the latest when the first part is pushed forward, at least partially reaches under the bottle neck of the first part and is carried along by it. The belly of the bottle has no direct contact with the blister. The blister preferably contains a bottle top for the bottle. Preferably, the blister has a defined area as the entrainment area, whereby the blister is then placed on the transport device in such a way that this entrainment area is aligned in the direction towards the bottle neck.

Preferably, the pushing device comprises plates or fingers spaced in the transport direction, each of which engages on the rear of a first part and pushes the corresponding first part together with the second part in the transport direction. Such pushing devices are known in principle. One finger each grips the rear side of a first part.

Preferably, a first robot places the first part and/or a second robot places the second part on the transport surface. Robots are predestined for this work because they work quickly and precisely and can also pick up the first or second part and align it as desired before depositing it on the transport device. Advantageous robots are, for example, designed as delta pickers with an additional fourth axis.

Preferably, the respective position of the first and/or second parts on the first or second feeding device is detected by preferably one detection device each. Based on the detected signal, the respective robot, as the first and/or the second robot, is then activated to place the first part or the second part with a defined orientation on the transport surface. In this way, randomly delivered first and/or second parts with a defined orientation can be placed on the transport surface.

According to an advantageous respective design, the second parts each have an identification mark, e.g. a barcode, at the same position. This identification mark is read by a detection device before the respective second part is placed on the transport device. The signal is processed by a control device to control the second robot, which then places the second part on the transport device with a defined orientation with respect to the placement of the identification mark. If, for example, in the above-mentioned example, an identification mark is placed on the top of the blister, the second robot can rotate the blister and place it on the conveyor in front of the first part such that the designated entrainment area always faces the driver area of the first part.

The first and/or the second parts are transported to the transport device by means of feeding devices, whereby the first and/or the second parts are preferably located on these feeding devices without a respective defined orientation. The feeding devices are designed as conventional conveyor belts, for example. The first and/or second parts can therefore be delivered non-ordered, for example by automatic or manual removal from a bulk packaging. The transfer of the first and/or second parts from the feeder(s) is then preferably done by one or more robots, preferably by a first robot for the first parts and a second robot for the second parts.

A preferred embodiment provides for a first part to be conveyed a defined distance by the pushing device before entraining a second part with its front side. The two parts can thus be placed on the transport surface with a mutual distance between them before the first part is conveyed by the pusher to the nearest second part and then pushes the second part in front of it, preferably by contacting its said driver area with the said entrainment area of the second part.

According to an alternative, a first part and a second part to be pushed by this first part are both already placed on the transport device in such a way that they lie against each other and are then immediately pushed together in the transport direction by the pushing device.

A tubular bag packaging machine (also called flow pack machine or flow wrap machine) is particularly preferred as the packaging device. The two parts conveyed on the transport surface in accordance with the invention can then be packed adjacent to each other and in the defined relative position in which they were already conveyed on the transport surface. The two parts thus remain in their respective positions in the tubular bag and can be easily grasped by a machine and without any troubles during further handling, especially when they are placed in larger packaging containers.

Figure 2:
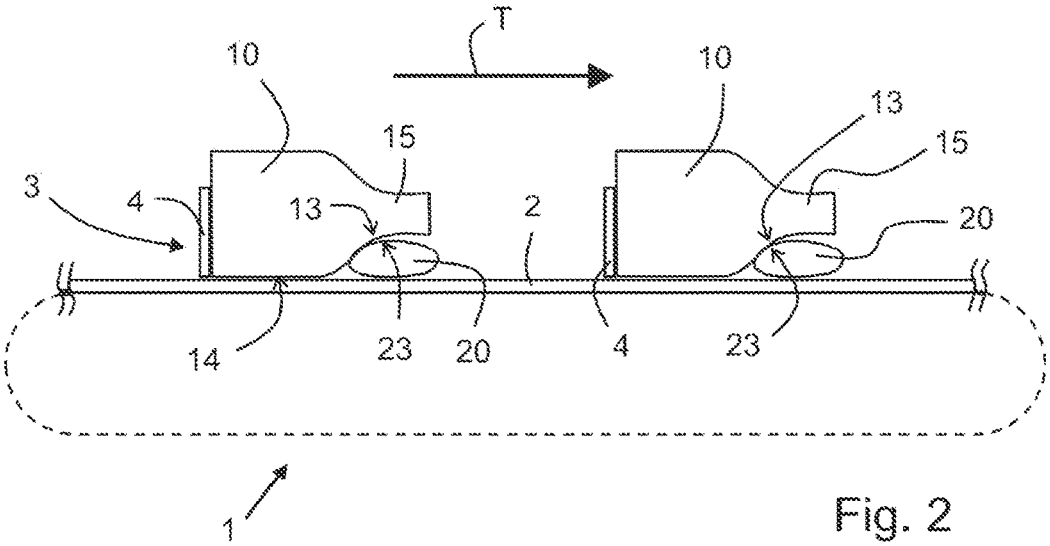
Figure 3:
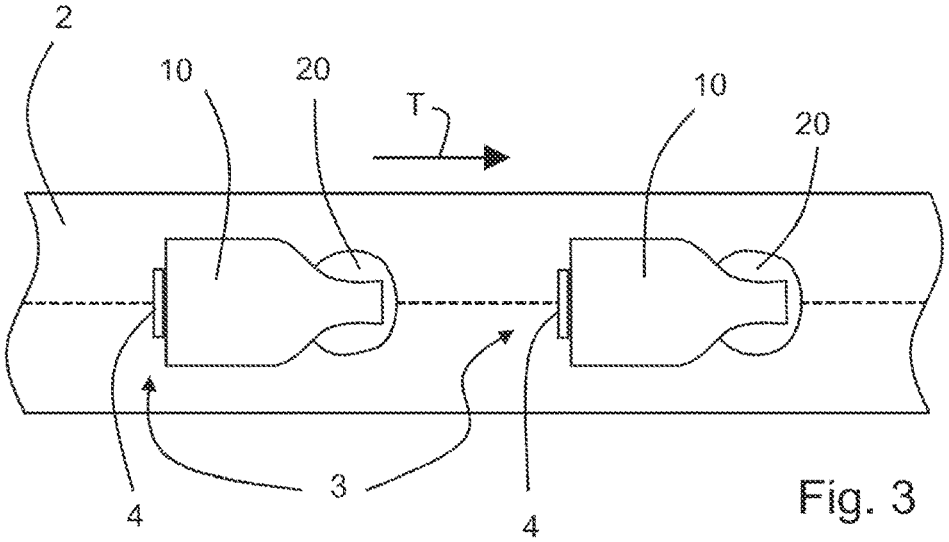

Advantageous further embodiments are characterized by the features of the subclaims. In the following, the invention is explained in more detail by means of figures. These show:

FIG. 1 a side view of a first and second part on a transport surface, before and when the second part is driven by the first part;

FIG. 2 a side view of two pairs of first and second parts transported one behind the other on a transport surface;

FIG. 3 a top view of the transport device of FIG. 2, and

Figure 4:
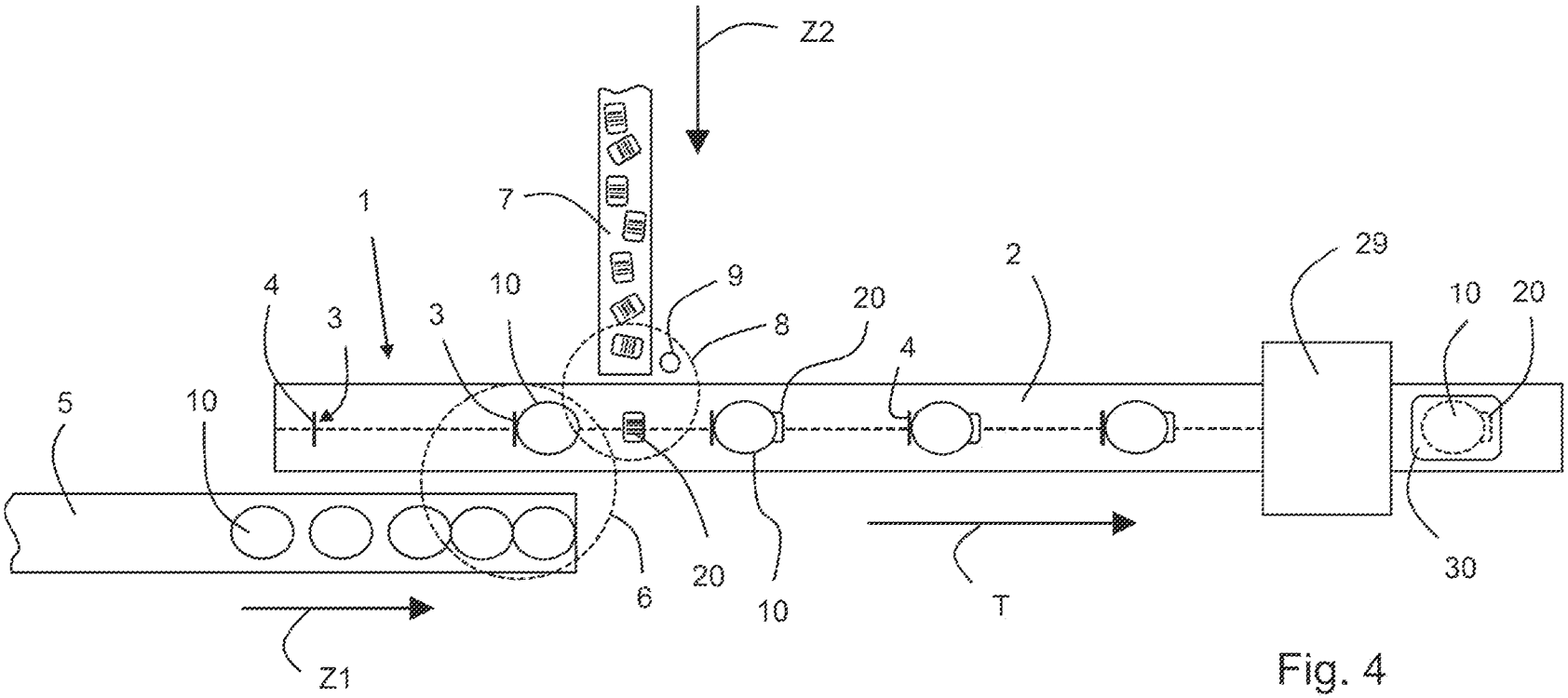

FIG. 4 a top view of a schematically shown packaging machine with feeding devices, robots, transport and packaging equipment.

FIG. 1 shows a section of a transport device 1 with a transport surface 2 in side view. On the transport surface 2, a first part 10 is placed in the form of a bottle, e.g. an infusion bottle to be used in hospitals. The first part 10 has a front side 11 and a rear side 12 and rests on transport surface 2 with a support section 14. The term "front side 11" generally refers to the front area of the first part 10, i.e. not exclusively its front face. The bottle preferably has an essentially rectangular cross-section, so that the support section 14 can be designed flat.

In the left half of FIG. 1, a second part 20 in the form of a blister with contents not shown, e.g. an adapter or attachment for the bottle, is placed on the transport surface 2 at some distance from the first part 10. Fingers 4 (only one is shown), spaced apart in the transport direction T of the transport device 1, protrude upwards from the transport surface 2 and are part of a pushing device 3. The transport surface 2 does not move itself in transport direction T; rather, only the pushing device 3 or its fingers 4 are conveyed, which for this purpose, for example, protrude through a central longitudinal slot in the transport surface 2 (indicated by a dashed line in FIGS. 3 and 4) and are carried along by an endless chain (not shown) arranged below the transport surface 2. The skilled person is also aware of a variety of other possibilities for driving the pushing device 3.

In the right half of FIG. 1, a finger 4 of the pushing device 3 grips the rear side 12 of the first part 10 and pushes it in transport direction T. When the first part 10 reaches the second part 20—which is initially not conveyed on the transport surface 2—the second part is carried along by the front side 11 of the first part 10 without coming into contact with the pushing device 3 itself.

In order to realize a defined entrainment of the second part 20 by the first part 10, the first part has a driver area 13 in the area of its front side 11. This driver area 13, which in the case of the bottle shown in the figures is formed by its bottle neck 15, has a section **13*a* which is spaced from the transport surface 2. The second part 20 gets between this section 13*a* and the transport surface 2 when the first part 10 reaches the second part 20 by the pushing action of the pushing device 3. Then, the first and the second part 10, 20 are pushed together over the transport surface 2**.

Every second part 20 has an entrainment area 23. In the embodiment shown in the figures, this results from the essentially rectangular or oval geometry of the second part 20 with two broad sides and two narrow sides. A safe contact of the second part 20 with the first part 10 is achieved if the second part 20 lies with one of its broad sides against the driver area 13, in this case in the area of the bottle neck 15, i.e. between bottle neck 15 and transport surface 2. The area of this broad side of the second part 20 serves as said entrainment area 23.

If the second part 20 is a blister with a bottle adapter for the first part 10 inserted therein, the first part 10 being embodied as a bottle, the irregular shape of this adapter determines the entrainment area 23 of the second part 20. The adapter has, for example, a broad side, whereby the second part 20 is then placed on the transport surface 2 with the broad side of the adapter being aligned in the direction of the first part 10.

FIG. 2 (side view) and FIG. 3 (top view) show the transport of two first and second parts 10, 20 pushed one behind the other in transport direction T on a transport surface 2. In addition, the circulation of the transport device 1 is indicated very schematically. As can be seen in the figures, a second part 20 gets to the driver area 13 of a first part. In the present case, the second part 20 has an entrainment area (here: a broad side of the second part 20), which is also flat enough to fit under the bottle neck 15 (see FIG. 1-3).

FIG. 4 shows a schematic top view of a packaging machine. The central element is the transport device 1 with its transport surface 2 and the pushing device 3, which has several fingers 4 spaced apart in transport direction T. A first feeding device 5 conveys first parts 10 in feeding direction Z1 parallel to the transport device 1 into the working area of a first robot 6 (symbolized as a dotted circle in the picture). The first robot 6 grips the first parts 10 one by one and places them on the transport surface 2 of the transport device 1.

Furthermore, a second feeding device 7 is provided, on which second parts 20 are fed in feeding direction Z2 perpendicular to the transport direction T according to the present example. If a second part 20 enters the working area of a second robot 8 (also symbolized by a dotted circle), this robot grips this second part 20 and deposits it on the transport surface 2 in front of a first part 10. A first and a second part 20 are placed between two fingers 4 of the pushing device 3. FIG. 4 shows how a first part 10 is pushed at its rear side 12 by a finger 4 in transport direction T towards the second part 20 placed in front of it. FIG. 4 shows three more pairs of first and second part 10 conveyed in transport direction T, each pushed by a finger 4.

The first parts 10 are already delivered in an order on the first feeder 5, for example standing upright. Alternatively, the first parts 10 are disordered on the feeder 5. Each first part 10 is gripped by the first robot 6 and placed on the transport surface 2 with a defined orientation. For the first parts 10, which are in the form of bottles, the bottle neck is placed on the transport surface 2 in transport direction T.

The second parts 20 are also placed on the transport surface 2 with a defined orientation. Their infeed on the feeding device 7 is disordered. A detection device 9, e.g. a camera or other optical device, is located near the transport device 1, which detects the position of every second part 20. In this case, every second part 20 has an identification mark 24, for example in the form of a bar code, on its upper side. The detection device 9 detects the rotational position of the second parts 20 around their respective vertical axis on the basis of the position of this identification mark 24 and transmits corresponding signals to a (not shown) control device, which in turn controls the second robot 8 and commands it to deposit the second part 20, which has been detected by the detection device 9, in a defined orientation on the transport surface 2. In this case, the second part 20 is deposited with a broad side in front of the first part 10. This broadside serves as the entrainment area 23 and is captured by the driver area 13 of the first part 10 so that the second part 20 can be pushed safely by the first part 10.

The pairs of first and second parts 10, 20 conveyed one after the other on the transport surface in transport direction T are conveyed into a known packaging device 29, which is designed as a tubular bag packaging machine and seals a first and a second part 10, 20 into a packaging 30, here a tubular bag. The packaging 30 can be tightly fitted to the two parts 10, 20, especially with respect to the two long sides facing in transport direction T. In this way, the two parts 10, 20 cannot slip relative to each other in transport direction T, so that especially a subsequent collective gripping of the packed first and second parts 10, 20 for packing into larger containers is possible without any problems.

The equipment of the packaging machine, including the transport device 1, the feeding devices 5, 7, the robots 6, 8, the recognition device 9 and the packaging device 29 are preferably controlled by a (not shown) control device.

The present invention was explained in more detail by means of an exemplary embodiment, but is not limited to this exemplary embodiment. Variations within the claims are possible without further ado. For example, the first and the second feeding device can also be aligned and/or designed differently in order to deliver the first and second parts, respectively. For example, the feeding directions Z1 and Z2 are arranged in opposite directions or at different angles to each other.

REFERENCE SIGNS

1 Transport device
2 Transport surface
3 Pushing device
4 Fingers
5 First feeding device
6 First robot
7 Second feeding device
8 Second robot
9 Detection device
10 First part
11 Front side of the first part
12 Rear side of the first part
13 Driver area
13*a* Section
14 Support section
15 Bottle neck
20 Second part
21 Front side of the first part
23 Entrainment area
24 Identification mark
29 Packaging device
30 Packaging
T Transport direction
Z1 Feed direction
Z2 Feed direction

The invention claimed is:

1. A method for automatic joint packaging of at least a first part and a second part, the first part and the second part having different geometries, the method comprising:

automatically placing the first part on a transport surface with a front side facing in a transport direction;

automatically placing the second part on the transport surface with the second part in front of the first part relative to the transport direction; and automatically transporting the first part and the second part along the transport surface to a packaging device by moving a pushing device into engagement with a rear side of the first part and pushing the first part in the transport direction, wherein the second part is taken along by the front side of the first part pushed by the pushing device, wherein a first robot places the first part on the transport surface and a second robot places the second part on the transport surface, and wherein a respective position of the first part and/or the second part is detected by a detection device, and wherein the first robot or the second robot, respectively, are controlled on the basis of the detected signal and placing the first part or the second part, respectively, on the transport surface.

2. The method of claim 1, wherein the front side of the first part includes a driver area, and when the first part is pushed, the driver area of the first part engages and pushes the second part with a portion of the front side of the first part at least partially overlapping a portion of the second part, and wherein the driver area of the first part is curved.

3. The method of claim 2, wherein the second part includes an entrainment area, and when the first part is pushed, the driver area of the first part engages the entrainment area of the second part and pushes the second part.

4. The method of claim 3, wherein the driver area of the first part is formed as a first part projection and the entrainment area of the second part is formed as a second part projection, and when the second part comes into contact with the first part, the first part projection engages the second part projection.

5. The method of claim 2, wherein the driver area of the first part includes an engagement section spaced from the transport surface, and when the second part comes into contact with the first part, at least a portion of the second part is located between the engagement section of the first part and the transport surface.

6. The method of claim 2, wherein the first part is a bottle, the driver area is a bottle neck of the bottle, and the second part is a blister, and when the second part comes into contact with the first part, the blister is carried along by the bottle neck.

7. The method of claim 1, wherein the pushing device comprises a plate which engages the rear side of the first part.

8. The method of claim 1, wherein the second part has an identification mark that is detected by the detection device before another second part is placed on the transport surface, and wherein the second robot is controlled on the basis of the detected signal and places the second part on the transport surface with a defined orientation with respect to the place of the identification mark.

9. The method of claim 8, wherein the first part and/or the second part are transported to the transport surface by means of a first feed device and/or a second feed device, and the transfer of the first part and/or the second part from the respective feed device is effected by means of the respective robot.

10. The method of claim 1, wherein the first part is conveyed a defined distance by the pushing device before entraining the second part with the front side of the first part.

11. The method of claim 1, wherein the packaging device comprises a tubular bag packaging machine.

* * * * *